United States Patent [19]

Frazier, Jr.

[11] 4,017,729

[45] Apr. 12, 1977

[54] DECORATIVE LAMP

[75] Inventor: Preston J. Frazier, Jr., Houston, Tex.

[73] Assignee: Faroy, Inc.

[22] Filed: May 11, 1973

[21] Appl. No.: 359,494

Related U.S. Application Data

[63] Continuation-in-part of Ser. No. 327,070, Jan. 26, 1973, abandoned.

[52] U.S. Cl. ..... 240/13; 240/10 B; 431/291; 240/10.1

[51] Int. Cl.[2] ..... F21V 35/00

[58] Field of Search ..... 431/126, 291; 240/10 B, 240/13, 10.1

[56] References Cited

UNITED STATES PATENTS

| | | | |
|---|---|---|---|
| 1,660,760 | 2/1928 | Murphey | 431/291 |
| 1,878,750 | 9/1932 | Adams | 240/10.1 |
| 1,980,665 | 11/1934 | Corbman et al. | 240/10.1 |
| 2,060,324 | 11/1936 | Knapp | 431/291 |
| 3,077,981 | 2/1963 | Gaspard | 431/291 |
| 3,286,492 | 11/1966 | Frazier | 431/291 |
| 3,473,014 | 10/1969 | Kayne | 240/1 B |
| 3,686,494 | 8/1972 | Naylor | 240/10.1 |

*Primary Examiner*—Carroll B. Dority, Jr.
*Attorney, Agent, or Firm*—Pravel, Wilson & Gambrell

[57] ABSTRACT

A decorative lamp for ornamentation, wherein an outer translucent shell serves as a housing for an inner candle holder having a design therewith, with the design being spaced from the outer shell, for projecting an image of the design to the shell so that it is visible on the shell and so that it has the appearance of movement as the candle flame flickers. In one form, the shell is convex to provide an enlarged form on the shell.

7 Claims, 6 Drawing Figures

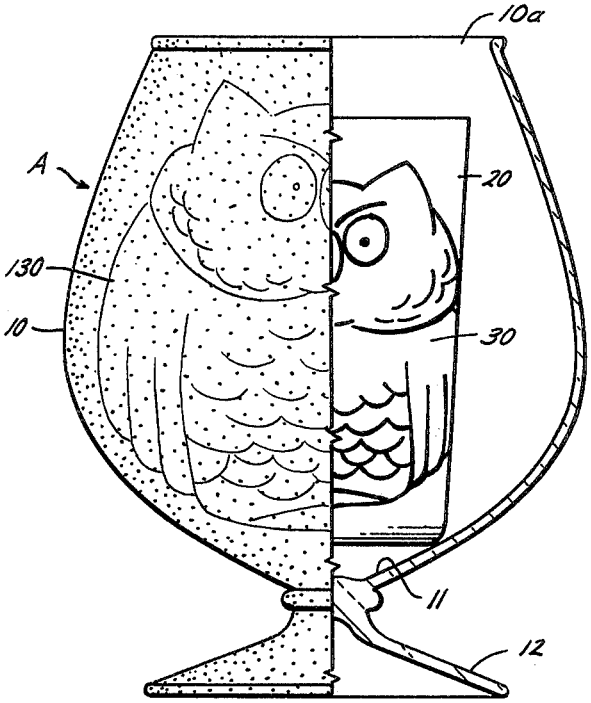
Fig. 1
Fig. 2
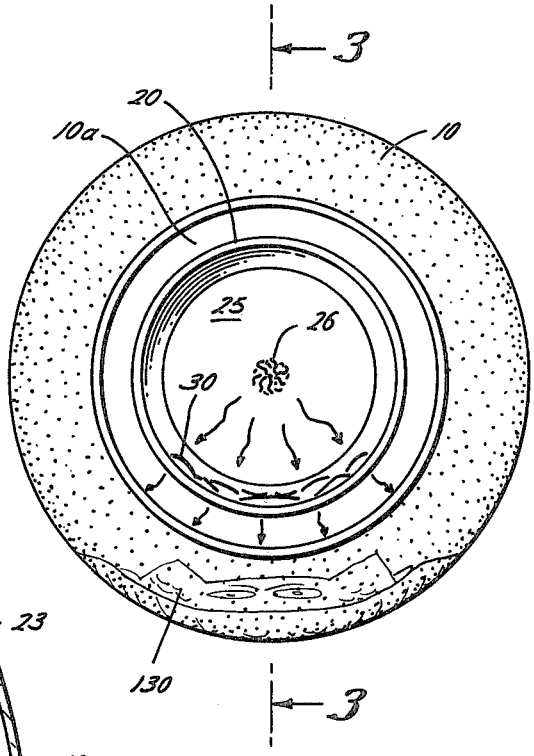
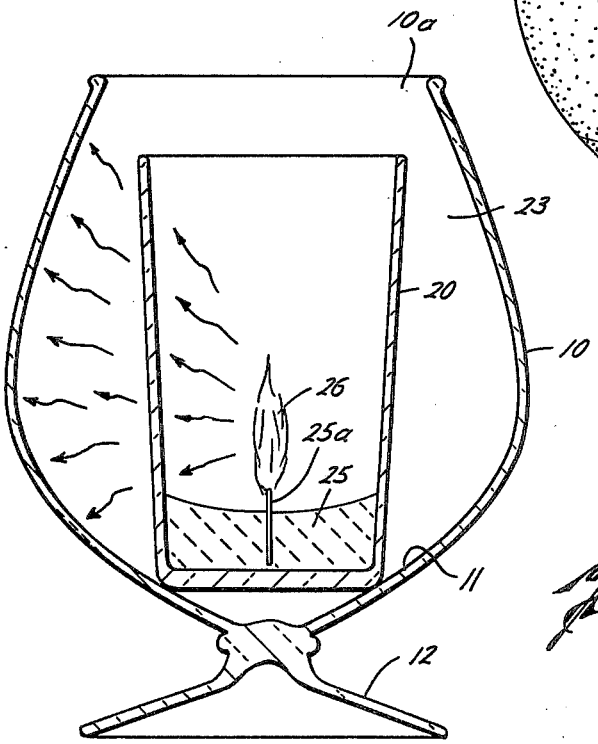
Fig. 3

DECORATIVE LAMP

CROSS-REFERENCE TO RELATED APPLICATION

This application is a continuation-in-part of U.S. Pat. application, Ser. No. 327,070 filed Jan. 26, 1973 and now abandoned.

BACKGROUND OF THE INVENTION

The field of this invention is decorative lamps.

In applicant's U.S. Pat. No. 3,286,492, a candle novelty was disclosed which utilized candle light to light up a message on a photographic strip in a translucent container.

SUMMARY OF THE INVENTION

The present invention relates to a decorative lamp in which a moving image is transmitted by candlelight to the surface of an outer translucent shell from a configuration in or on the surface of an inner candle holder which is spaced therefrom, whereby a unique decorative effect is obtained with the candelight. The image may also be enlarged to further enhance the effect.

BRIEF DESCRIPTION OF THE DRAWINGS

FIG. 1 is a vertical view, partly in section and partly in elevation, illustrating one form of the decorative lamp of this invention;

FIG. 2 is a plan view of the decorative lamp shown in FIG. 1, and illustrating the projection of the enlarged image from the inner candleholder to the surface of the outer shell by the flame from the candle within the candleholder;

FIG. 3 is a vertical sectional view taken on line 3—3 of FIG. 2 and further illustrates the projection of the enlarged image from the inner candleholder to the outer shell with the candle flame;

DESCRIPTION OF THE PREFERRED EMBODIMENT

Figure 4:
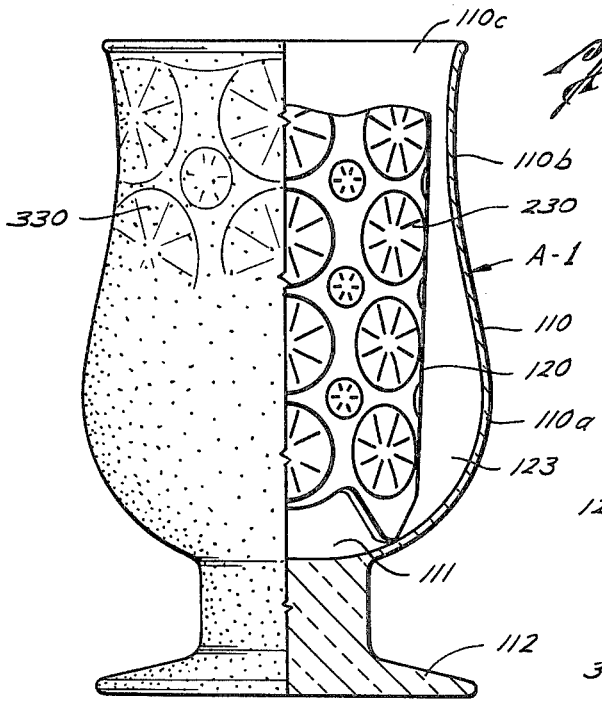
FIG. 4 is a vertical view, partly in section and partly in elevation, illustrating another form of the decorative lamp of this invention.

In the drawings, the letter A designates generally the decorative lamp of this invention which is adapted to project an enlarged image of a design from the surface of a candleholder to an outer surface which is visible to a person. The candle flame within the candleholder is disposed directly behind or inwardly of the design so that the image which is projected from the design appears to have movement when the candle flame flickers or burns irregularly.

Considering the invention more specifically, the decorative lamp A includes an outer shell 10 which is preferably a brandy glass having a glass wall which is convex in shape as viewed from the exterior thereof. The glass or shell 10 has a bottom 11 which is preferably closed and which has connected therewith a base 12 of any conventional configuration or design, but preferably of a typical round disc shape as shown in the drawings for supporting the entire lamp A. Preferably the shell 10 and the base 12 are formed of frosted or etched glass which is translucent so that light may pass therethrough, but at least partially obscuring the view of any object within the glass.

The upper end 10*a* of the glass or shell 10 is open for receiving a candleholder 20. The candleholder 20 is also preferably formed of glass and it is normally clear or transparent. The candleholder 20 is disposed on the bottom of the brandy glass or shell 10 as best seen in FIGS. 1 and 3, so that the candleholder 20 has its axis substantially vertical and concentrically aligned with the axis of the shell or glass 10.

The wall of the candleholder 20 is substantially cylindrical so as to form a cylinder within the convex shell 10. The diameter of the cylinder forming the vertical portion of the candleholder 20 is substantially less than the diameter of the convex glass or shell 10, thereby forming an annular space 23 between the external surface of the candleholder 20 and the internal surface of the shell 10. The dimensions of such annular space 23 vary, as will be appreciated from viewing the drawings, due to the bulging of the convex surface 10 in the midportion of its vertical height, but generally speaking, the annular space from the external surface of the cylindrical candleholder 20 to the internal surface of the shell 10 is approximately equal to the radius of the cylindrical portion of the candleholder 20. As will be more evident hereinafter, such relative dimensions are by way of example and are not to be construed as limiting with respect to this invention.

The candleholder 20 has a candle 25 therein, preferably occupying only the extreme lower portion of the candleholder 20 as illustrated in FIG. 3 of the drawings. The candle 25 has a conventional wick 25*a* therewith which has a flame 26 therefrom that is disposed substantially centrally within the candleholder 20 and conveys light therefrom to the entire candleholder 20 above the candle 25.

A design 30, which is illustrated in the drawings as an owl is applied to all or a portion of the vertical wall of the candleholder 20, either on the inside or the outside thereof. Such design 30 may be printed, painted, silk screened or otherwise formed in or on the wall or applied thereto. A decal having a design thereon may also be utilized. The term "design" as used herein includes lettering or any other indicia, but normally, because of the unique effect obtained by the enlarged projection of the design 30 as will be more evident hereinafter, such design 30 takes the form of flowers, an owl or other objects which become more interesting when they appear to have some movement.

As best illustrated in the drawings, an image 130 of the design 30 is projected to the inner surface of the outer shell 10 by the light from the flame 26 and such image 130 is enlarged as compared to the design 30, which is due to a combination of the spacing provided by the annular space 23 and the curved convex surface of the glass or shell 10. Because the flame flickers, the light intensity projecting the image 130 varies and shifts so that the image 130 appears to move or dance on the shell 10, as viewed by a person looking at the shell 10 from the outside.

For the best effect, the upper end of the candleholder 20 is disposed below the upper edge of the glass 10 so that when the candle 25 is not lit, neither the design nor the candleholder 20 is visible from the side of the glass or shell 10.

Figure 5:
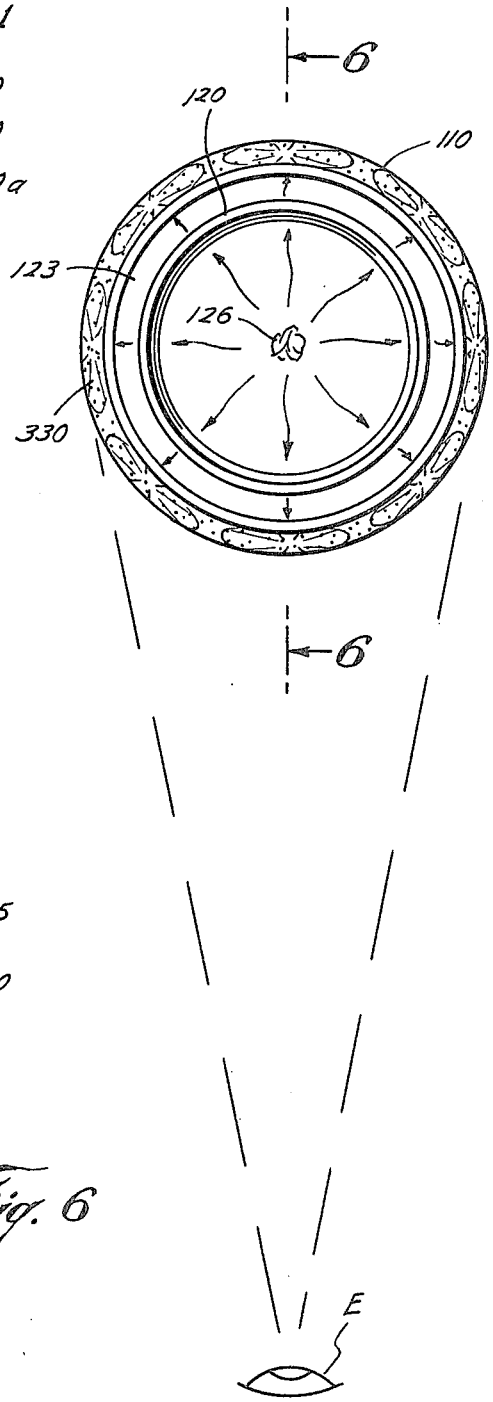
FIG. 5 is a plan view illustrating the projection of the image from the design in the glass of the inner candleholder to the surface of the outer shell by the flame from the candle within the candleholder.
Figure 6:
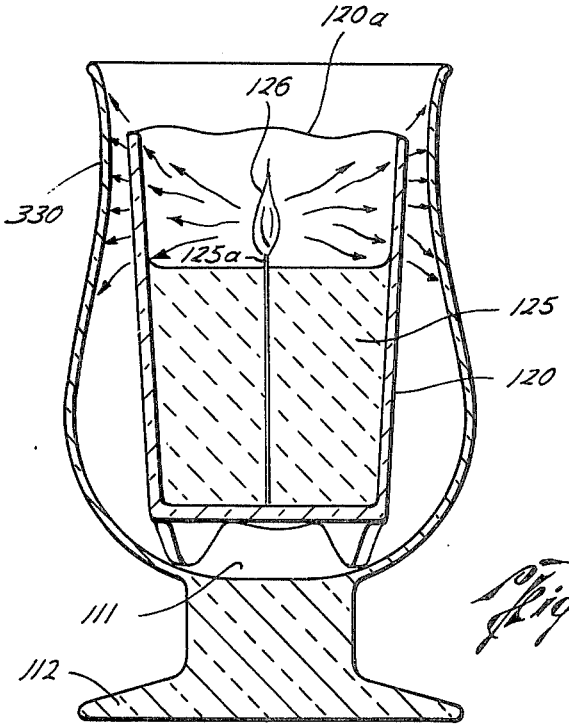
FIG. 6 is a sectional view taken on line 6—6 of FIG. 5 to further illustrate the invention.

In FIGS. 4–6, a second form of the invention is illustrated wherein the letter A-1 designates generally the modified decorative lamp having an outer shell 110 which corresponds with the outer shell 10 of FIG. 1, but which is shaped differently. Thus, the outer shell 110 is substantially cylindrical in the same manner as the shell 10, but the lower portion of the shell 110 is convex as indicated at 110*a* whereas the upper portion 110*b* is concave. The outer shell 110 is preferably formed of glass or other material through which light will pass, and in the preferred form of the invention, the glass is etched or is frosted so as to substantially obscure viewing through the glass unless there is a light internally of the shell 110, as will be more evident hereinafter.

The glass or shell 110 has a bottom 111 which is preferably closed and which has connected therewith a base 112 of any conventional design or configuration. The upper end 110*c* of the outer shell 110 is open so as to receive a candleholder 120 which corresponds with the candleholder 20 of FIGS. 1–3.

The candleholder 120 is formed with substantially cylindrical walls and it has a bottom for holding a candle 125 (FIG. 6), the upper surface 125*a* of which is preferably considerably below the upper edge 120*a* of the holder 120. Such arrangement locates the exposed end of the wick 125*a* so as to provide a flame 126 within the upper portion of the candleholder 120 as best seen in FIG. 6.

The candleholder 120 is preferably formed of a glass or other transparent material through which light will pass and which has a design therewith or thereon. In the particular form of the invention illustrated in FIGS. 4–6, the candleholder 120 has a design formed in the surface of the glass which design is represented by the numeral 230. Such design 230 is preferably formed in the glass itself and is of different thicknesses and projects outwardly and inwardly different amounts depending upon the design so that light from the candle flame 126 passes through such design 230 in different amounts, depending upoin the particular design 230 that is formed with the glass of the candleholder 120.

It should also be understood that the candleholder 20 of FIGS. 1–3 may be replaced by the candleholder 120 in FIGS. 1–3. Similarly, the candleholder 120 of FIGS. 4–6 may be replaced by the candleholder 20.

It is to be noted that the candleholder 20 is spaced substantially uniformly from the inner wall of the outer shell 110 so as to provide an annular space 123 between the candleholder 120 and the shell 110. Such spacing is important in that it permits the flickering of the candle flame 126 to transmit its flickering to the design image 330 which appears on the surface of the outer shell 110 to an observer. Such flickering of the candle 126 in transmitting the design image 330 results in an appearance of movement of the design on such outer shell 110. Also, there is an appearance of an enlargement or magnification of the image on the outer shell 110, particularly in the convex portions of the outer shell 110. This effect is illustrated in the drawings and a person's eye is designated E in FIG. 5 to illustrate the effect which is produced. It should also be noted that the design 230 in the candleholder 120 is substantially uniform throughout its full external surface so that the image 330 appears to be on the entire external surface of the outer shell 110 to the observer's eye E.

It is believed evident that the effect obtained with the present invention may be varied by varying the particular candleholder within the outer shell and the design therewith or thereon. Likewise, by varying the particular configuration of the outer shell from that shown in FIGS. 1–3 to that shown in FIGS. 4–6, different effects may be obtained, using the same candleholder. It will be appreciated that the invention is not limited to the particular configuration of the outer shell 10 or 110 since these configurations may be varied for different esthetic effects. It should also be pointed out that the glass of the outer shells 10 and 110 is preferably clear or white and frosted, but the candleholders 20 and 120 may be formed of colored glass or clear glass and the esthetic effects obtained may be varied by changing such colors of the glass itself as well as the designs with or on the glass of the candleholders. So long as the design image is viewable, the outer shell 10 or the outer shell 110 may have some coloration also.

The foregoing disclosure and description of the invention are illustrative and explanatory thereof and various changes in the size, shape and materials, as well as in the details of the illustrated construction, may be made within the scope of the appended claims without departing from the spirit of the invention.

I claim:

1. A decorative lamp, comprising:

an outer shell having a substantially cylindrical surface, a bottom, and an open upper end;

an inner non-rotating candleholder disposed in a selected seated position in said outer shell for holding a candle;

the external surface of said candleholder having a design through which light may pass from a candle in said candleholder; and said external surface of said candleholder being spaced from said substantially cylindrical surface for the projection of an image of said design onto said outer shell from a candle in said candleholder so that it is visible from externally of said outer shell and so that the image thereof flickers to give the effect of movement of the design by reason of candlelight from a candle in the candleholder flickers.

2. The decorative lamp set forth in claim 1, including:

a candle disposed in said candleholder to position the flame from the candle directly behind said design for effecting the appearance of said movement of the design on the outer shell when the flame flickers.

3. The lamp set forth in claim 2, wherein:

said candle occupies only the lower portion of said candleholder.

4. The decorative lamp set forth in claim 1, wherein:

said external surface of said candleholder is a curved convex surface, whereby the image of the design is enlarged as compared to the size of the design on the candleholder.

5. The decorative lamp set forth in claim 4, wherein:

said outer shell is made of etched glass for at least partially obscuring said candleholder when the candle therein is not lit; and the upper end of the candleholder is below the upper end of said shell so that said candleholder is not exposed to view from the side of the shell.

6. The decorative lamp set forth in claim 1, wherein:

said design is applied to said external surface of said candleholder.

7. The decorative lamp set forth in claim 1, wherein:

said design is formed in said external surface of said candleholder, and said design is transparent, with some portions permitting the passage of more candlelight than other portions.

* * * * *